United States Patent [19]

Smith

[11] Patent Number: 5,040,638

[45] Date of Patent: Aug. 20, 1991

[54] WHEELCHAIR LIFT MECHANISM

[75] Inventor: Dave W. Smith, Calgary, Canada

[73] Assignee: Adaptive Engineering Ltd., Calgary, Canada

[21] Appl. No.: 560,810

[22] Filed: Jul. 31, 1990

[51] Int. Cl.[5] ..... B66F 7/02

[52] U.S. Cl. ..... 187/8.59; 187/11

[58] Field of Search ..... 187/8.59, 11, 21, 22, 187/23, 26, 27, 73, 80; 254/258, 268, 288, 311, 329, 332, 378; 414/921

[56] References Cited

U.S. PATENT DOCUMENTS

| | | | |
|---|---|---|---|
| 1,710,442 | 4/1929 | Warshaw | 187/8.59 |
| 2,894,605 | 7/1959 | Leavitt | 187/11 |
| 3,480,255 | 11/1969 | Wiggins | 254/268 |
| 4,269,973 | 5/1990 | Smith . | |

*Primary Examiner*—Robert P. Olszewski

*Assistant Examiner*—Dean A. Reichard

*Attorney, Agent, or Firm*—Murray E. Thrift; Stanley G. Ade; Adrian D. Battison

[57] ABSTRACT

A platform is mounted on a frame for vertical movement on the frame. The platform is raised and lowered using a pair of drums mounted for both rotational and translational movement on the frame. Cables on the drums and connected to the platform tend to rotate and translate the drums. The translation is resisted by brake bands wrapped around the drums, which in turn prevent rotation of the drums. For raising and lowering purposes, the drums are equipped with chain sprockets and drive chains that may be driven to rotate the drums about their axes and also to translate the drums in a direction opposite the translation caused by the weight of the platform. This unloads the band brakes and allows the platform to move.

2 Claims, 3 Drawing Sheets

WHEELCHAIR LIFT MECHANISM

FIELD OF THE INVENTION

This invention relates to new and useful improvements in mobile wheelchair lifts and in particular, drive and braking systems therefore.

BACKGROUND

U.S. Pat. No. 4,926,973, issued May 22, 1990 describes a lift designed to raise a person in a wheelchair from a passenger platform up to a rail car door and vice versa. The lift may also be used in other environments. The disclosure of that patent is incorporated herein by reference.

The patented lift is extremely light and easy to handle because of the extensive use of aluminum in the construction thereof. It is also portable since when the platform is in a lowermost position, the frame is raised and ground engaging wheels under the platform enable the entire device to be moved from one location to another.

The prior lift uses a manual cranking drive system which includes a braking system that is activated by the load on the wheelchair deck so that the manual effort required to crank the lift downwardly is proportional to the load on the deck.

The present invention is concerned with a novel drive and braking system for such a device.

SUMMARY

In accordance with one aspect of the invention there is provided an operating system for a lift having a frame, a platform and a platform mounting means mounting the platform on the frame for vertical movement thereon, the platform mounting means including means for maintaining the platform in a level orientation, the operating system comprising:

a drum having a drum axis;

means mounting the drum for rotation about the drum axis;

means mounting the drum for movement transversely of the drum axis;

brake means engageable in response to movement of the drum in one direction transversely of the drum axis to brake rotation of the drum;

flexible tension means wound on the drum and secured to the platform such that tension on the tension means urges the drum to move in said one direction;

flexible power transmitting means engaged with the drum; and drive means engaged with the flexible power transmitting means for driving the flexible power transmitting means, the drive means being so positioned that tension on the flexible power transmitting means urges the drum to move in a direction opposite said one direction.

With this arrangement, raising the platform draws the drum out of engagement with the brake. On release of the tension in the power transmitting element, the weight of the platform draws the drum into engagement with the brake, automatically resetting it. In lowering the platform, the drum is also urged away from brake engagement. The weight of the platform and any load assist the lowering action.

In accordance with another aspect of the invention, there is provided a lift comprising:

a platform;

a frame;

platform mounting means mounting the platform for vertical movement on the frame, the platform mounting means including means for maintaining the platform at a level orientation;

a pair of drums having spaced apart, parallel axes;

a pair of drum mounting links, having respective ones of the drums mounted thereon for rotation about the respective drum axes, the links being mounted on the frame for rotation about link axes parallel to the drum axes;

a pair of brake bands engaged about respective ones of the drums;

a pair of brake anchors secured to the respective brake bands between the drums;

a pair of first cables wound on the respective drums, running off the drums on sides thereof opposite the brake anchors and secured to the platform;

a pair of second cables each wound on a respective one of the drums in a direction opposite the winding direction of the first cable wound thereon and running off the drum on the same side as the first cable;

a pair of second cable anchors mounted on the platform and extending vertically therefrom, the second cable anchors being secured to the respective second cables;

a pair of drum sprockets mounted on the drums;

a pair of drive chains engaged with the respective drum sprockets;

a pair of drive sprockets engaged with the drive chains between the drums;

means coupling the drive sprockets for simultaneous rotation thereof;

a reversing sprocket engaged with one of the drive chains such that the drums rotate simultaneously in opposite directions;

chain tensioning means for tensioning the drive chains; and hand crank means for turning the drive sprockets;

BRIEF DESCRIPTION OF THE DRAWINGS

In the accompanying drawings, which illustrate exemplary embodiments of the present invention.

DETAILED DESCRIPTION

Figure 1:
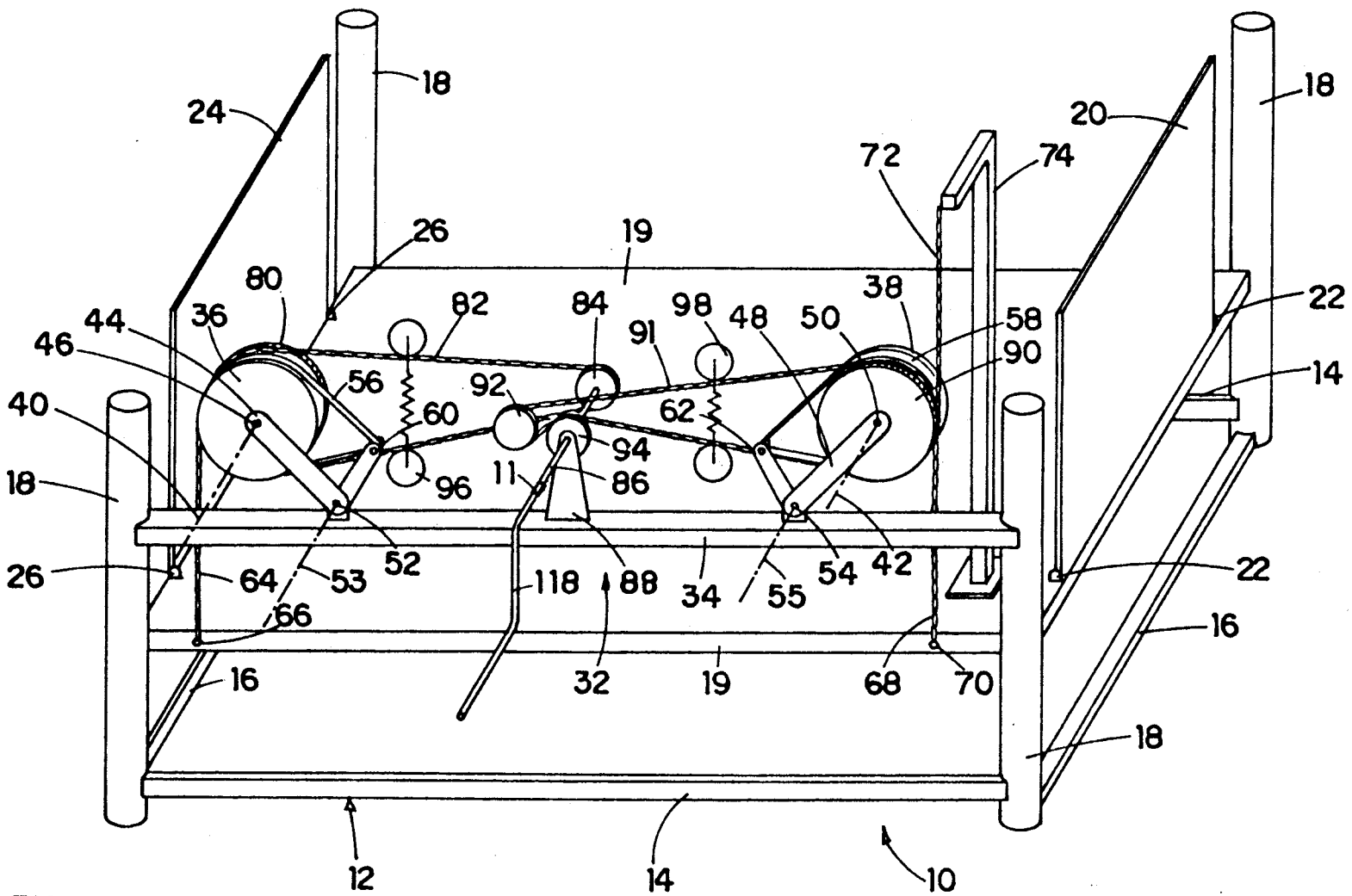
FIG. 1 is a partially schematic isometric view of the wheelchair lift showing the braking system with certain parts removed for clarity.
Figure 2:
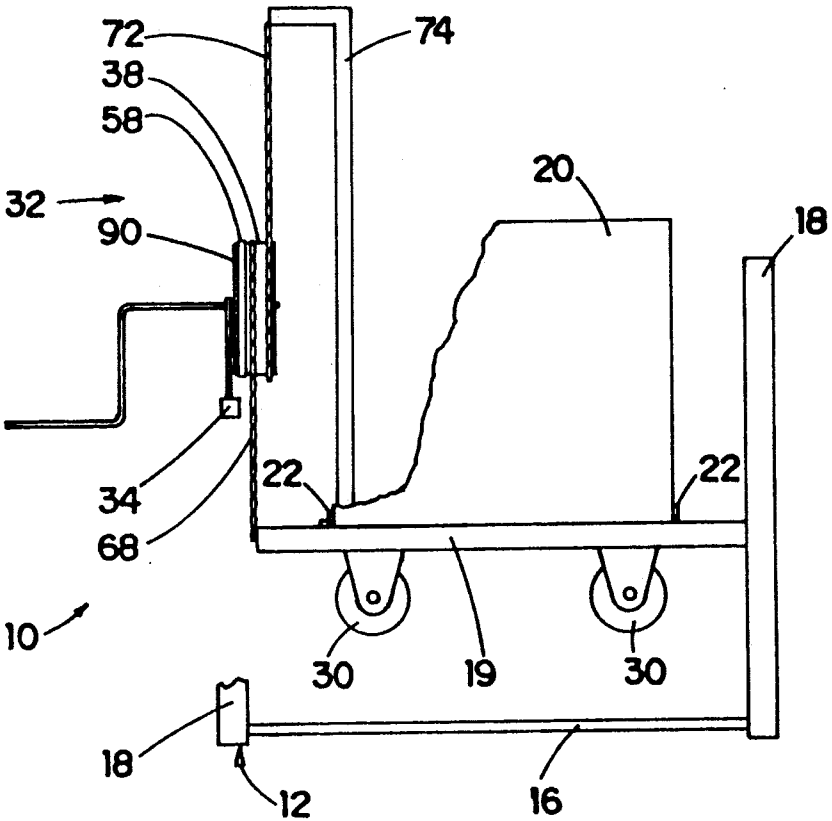
FIG. 2 is a right side elevation, partially broken away.

Referring to the accompanying drawings there is illustrated a lift 10 having a frame consisting of a pair of longitudinal members 14 and a pair of transverse frame members 16 connected to four corner standards 18.

The frame carries a platform 19 which moves vertically on the frame as discussed in the following.

The platform carries an end ramp 20 hinged to one edge of the platform by hinges 22. The ramp is shown in a raised position in FIG. 1. It may be folded down to provide an access ramp to the platform. At the opposite side of the platform is a similar fold-up ramp 24 mounted on the platform by hinges 26.

The platform 19 is a equipped with ground wheels 30 on the underside. These support the platform on the ground when it is lowered and may be used to support the entire lift where the frame is raised on the platform for transportation purposes.

The platform is raised and lowered on the frame by a lift operating mechanism 32 mounted on a longitudinal frame member 34 extending between and secured to two of the standards 18. The operating mechanism includes two drums 36 and 38 with respective drum axes 40 and 42. The drum 36 is mounted for rotation on a mounting link 44 by a shaft 46. The drum 38 is likewise mounted for rotation on a mounting link 48 by a shaft 50.

The mounting link 44 is supported on the frame member 34 by a link pivot 52 having an axis 53 generally parallel to the drum axis 40. The mounting link 48 is mounted on the frame member 34 by a link pivot 54 having a pivot axis 55 parallel to the drum axis 42.

Two brake bands 56 and 58 engage the drums 36 and 38 respectively. These are connected to brake anchors 60 and 62 mounted on the frame member 34 between the two drums.

Figure 4:
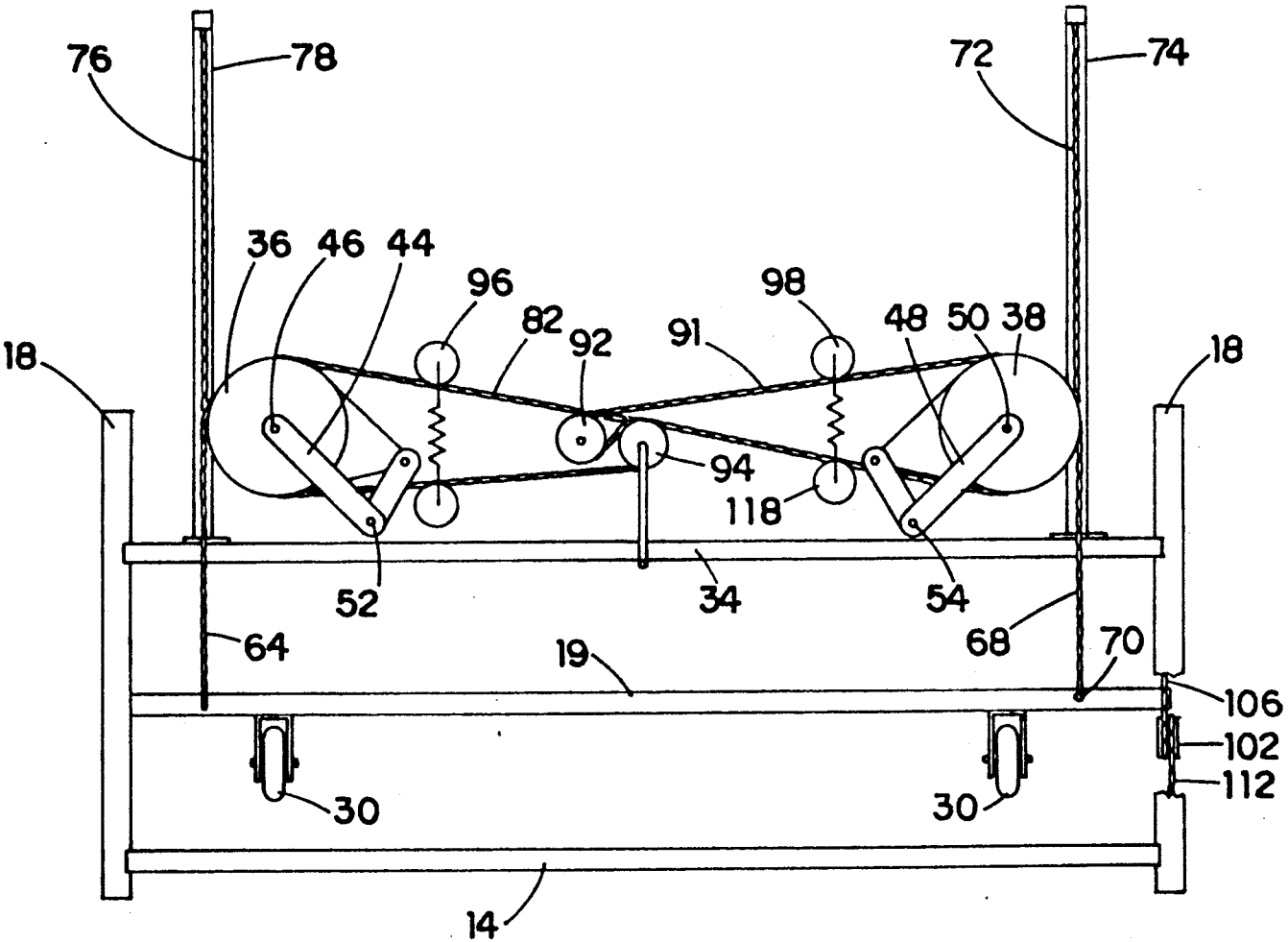
FIG. 4 is a partially schematic front elevation showing a modification of the lift.

A cable 64 is wound on the drum 36 and runs off the outer side of the drum to a cable anchor 66 on the platform 19. Similarly, a cable 68 is wound on the drum 38 and runs off the outer side of the drum to a cable anchor 70 on the platform 19. A third cable 72 is wound on the drum 38 in the opposite direction from cable 68 and runs from the outer side of the cable upwardly to a cable arm 74 carried by the platform. In the embodiment of the invention illustrated in FIG. 4 an additional cable 76 like cable 72 is wound on drum 36 and runs upwardly from the outer side of the drum to a second cable arm 78 like arm 74.

The drum 36 carries a large diameter chain sprocket 80. This engages a chain 82 that is in turn engaged about a sprocket 84 mounted on a shaft 86 between the two drums 36 and 38. The shaft 86 is mounted on frame member 34 by a shaft support 88.

The drum 38 also carries a sprocket 90 that engages a chain 91. The chain 91 runs around a reversing sprocket 92 on the opposite side of shaft 86 from drum 38. In the reach of the chain between sprocket 92 and sprocket 90, the chain is engaged on the outside by a drive sprocket 94 carried on the shaft 86. Sprocket 92 thus acts a reversing sprocket to ensure that the two drums rotate in opposite directions when the shaft 86 is rotated.

The chains 82 and 91 are intentionally left slack to provide for movement of the drums 36 and 38 around the axes 53 and 55 of the mounting link pivots. In consequence, slack chain idlers 96 and 98 are used to maintain the chains in engagement with the respective sprockets without applying a significant amount of tension on the chains. These are conventional devices and will not be described in detail.

Figure 3:
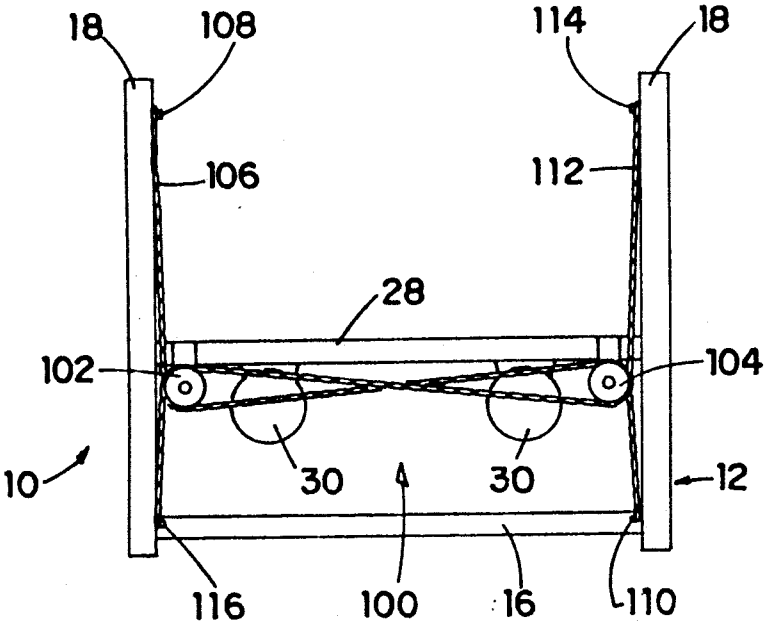
FIG. 3 is a fragmentary side elevation partially schematic and showing the platform mounting system.

FIG. 3 shows a platform mounting assembly 100 which maintains the deck or platform 28 horizontal during the elevating and lowering thereof. The assembly includes two double pulleys 102 and 104 a opposite ends of the platform. A cable 106 is secured one end to a standard 18, adjacent its upper end by an anchor 108. The cable 106 extends downwardly and under pulley 102. Cable 106 then runs along the side of the platform, over pulley 104 and then down the opposite standard 18 to an anchor 110. Similarly, a cable 112 is connected to an anchor 114 on the second standard and runs down, under pulley 104, over pulley 102 and then downwardly to the lower anchor 116.

The drive shaft 86 of the apparatus is driven by a hand crank 118. This crank is connected to the end of the shaft with a hinge 11 that is spring biased with an internal spring to pivot the crank towards the frame of the lift sufficiently that it will engage the frame of the lift. The crank will thus act as a secondary fail safe brake to limit the travel of the platform.

When the platform of the apparatus is stationary, the tension on the cable 64 tends to rotate the drum 36 counterclockwise, while the tension on cable 68 tends to rotate the drum 38 clockwise. The cable tension also tends to rotate the drum mounting links in the same counterclockwise and clockwise directions about their respective link pivots. The pivotal movement about the link pivots is prevented by the brake bands 56 and 58. The resulting frictional engagement of the bands with the drums also prevents the rotation of the drums about the drum axes. The geometry of the system is selected such that the brake band provides sufficient braking torque to prevent rotation of the drum, so that the platform is locked into position. As the load on the platform increases, the load on the drum and band brake will also increase. The braking torque will increase linearly with the load on the platform and the platform will always be held motionless regardless of the size of the load. As discussed above, the drive chains are slack in order to provide this function, since tight drive chains would prevent the movement of the drums and their mounting links about the link axes 53 and 55.

If it is desired to raise the platform, the crank handle is turned in a clockwise direction as seen in FIG. 1. This places tension on the top runs of the drive chains 82 and 91. Considering the drum 36, the tension on the chain 82 tends to rotate the drum clockwise, which will raise the platform. It also tends to rotate the drum and its mounting link 44 clockwise around the axis 53, which removes the load completely from the brake band 56. Consequently, in raising the platform, the band brake is completely inactive and the platform can be raised with no braking resistance and with very high mechanical efficiency. A similar effect occurs with drum 38 and brake band 58.

When the platform is raised to an appropriate height, and the crank 118 is released, the drums again move in a direction transverse to their drum axes in response to tension on the cables, thus engaging the brake bands with the drums to stop rotation.

To lower the platform, the crank handle is turned in a counterclockwise direction. This tensions the lower run of each of the chains 82 and 91 and tends to rotate the winding drums. Considering drum 36, the drum will tend to rotate counterclockwise while the drum will move transversely of the drum axis 40, about the mounting link pivot axis 53. The movement of the drum transverse to its axis partially unloads the brake band. It will be observed that the torque applied to the drum about the mounting link axis is less than the torque applied in raising the platform because of the much shorter moment arm between the pivot axis and the lower run of the chain. This partial unloading of the brake means that when cranking the platform downwards, the operator does not have to overcome the full frictional effect of the band brake. This arrangement yields a high degree of safety and minimizes the manual effort required to crank the lift downward.

The cables 72 and 76 and their cable arms 74 and 78 respectively serve for platform return purposes. They force the platform downward rather than relying on gravity to draw the platform down.

While particular embodiments of the present invention has been described in the foregoing, it is to be understood that other embodiments are possible within the scope of the invention. It is, for example, possible to construct a device with a single drum and cable arrangement, where demands of the system can adequately be met by such an arrangement.

It is to be understood that the invention is not to be considered limited to the embodiments described herein but solely by the scope of the appended claims.

I claim:

1. An operating system for a lift having a frame, a platform and a platform mounting means mounting the platform on the frame for vertical movement thereon, the platform mounting means including means for maintaining the platform in a level orientation, the operating system comprising:

a drum having a drum axis;

means mounting the drum for rotation about the drum axis;

means mounting the drum for movement transversely of the drum axis;

brake means engageable in response to movement of the drum in one direction transversely of the drum axis to brake rotation of the drum;

flexible tension means wound on the drum and secured to the platform such that tension on the tension means urges the drum to move in said one direction;

flexible power transmitting means engaged with the drum; and drive means engaged with the flexible power transmitting means for driving the flexible power transmitting means, the drive means being so positioned that tension on the flexible power transmitting means urges the drum to move in a direction opposite said one direction.

2. A lift comprising:

a platform;

a frame;

platform mounting means mounting the platform for vertical movement on the frame, the platform mounting means including means for maintaining the platform at a level orientation;

a pair of drums having spaced apart, parallel axes;

a pair of drum mounting links, having respective ones of the drums mounted thereon for rotation about the respective drum axes, the links being mounted on the frame for rotation about link axes parallel to the drum axes;

a pair of brake bands engaged about respective ones of the drum;

a pair of brake anchors secured to the respective brake bands between the drums;

a pair of first cables wound on the respective drums, running off the drums on sides thereof opposite the break anchors and secured to the platform;

a pair of second cables each wound on a respective one of the drums in a direction opposite the winding direction of the first cable wound thereon and running off the drum on the same side as the first cable; a pair of second cable anchors mounted on the platform and extending vertically therefrom, the second cable anchors being secured to the respective second cables;

a pair of drum sprockets mounted on the drums;

a pair of drive chains engaged with the respective drum sprockets;

a pair of drive sprockets engaged with the drive chains between the drums;

means coupling the drive sprockets for simultaneous rotation thereof;

a reversing sprocket engaged with one of the drive chains such that the drums rotate simultaneously in opposite directions;

chain tensioning means for tensioning the drive chains; and hand crank means for turning the drive sprockets.

* * * * *